United States Patent [19]

Arms

[11] Patent Number: 4,527,695

[45] Date of Patent: Jul. 9, 1985

[54] GARBAGE CAN RACK

[76] Inventor: Rondy Arms, 515 N. Dorothy, Shawnee, Okla. 74801

[21] Appl. No.: 516,920

[22] Filed: Jul. 25, 1983

[51] Int. Cl.[3] ..... A47G 29/00

[52] U.S. Cl. ..... 211/71; 248/DIG. 7

[58] Field of Search ..... 211/71; 248/DIG. 7, 248/146

[56] References Cited

U.S. PATENT DOCUMENTS

| | | | |
|---|---|---|---|
| 2,546,797 | 3/1951 | Swisher | 248/DIG. 7 |
| 3,080,978 | 3/1963 | Gress | 211/71 |
| 3,173,547 | 3/1965 | Alissandratos | 211/71 |
| 3,186,555 | 6/1965 | Ventura | 248/DIG. 7 |
| 3,227,284 | 1/1966 | Smith | 248/DIG. 7 |
| 3,547,273 | 12/1970 | Bomport | 248/146 X |
| 3,788,583 | 1/1974 | Byrd | 248/DIG. 7 X |
| 3,990,654 | 11/1976 | Michael | 211/71 X |

*Primary Examiner*—Ramon S. Britts
*Assistant Examiner*—Sarah A. Lechok
*Attorney, Agent, or Firm*—William R. Laney

[57] ABSTRACT

A rack for supporting and retaining garbage cans which includes a vertically extending supporting member, a pair of vertically spaced, horizontally extending arms each attached at a central portion of the respective arm to the supporting member, a pair of arcuate, generally semi-circularly curved, supporting elements each secured at a point on the periphery thereof to the lower of said two horizontally extending arms, and a pair of horizontally spaced handle retention tabs secured to the upper of said horizontally extending arms above the points of securement of the lower of the horizontally extending arms to the arcuate supporting elements.

3 Claims, 4 Drawing Figures

GARBAGE CAN RACK

BACKGROUND OF THE INVENTION

1. Field of the Invention

This invention relates to a garbage rack for supporting and retaining garbage cans.

2. General Description of the Prior Art

A number of types of garbage can racks have heretofor been proposed. The geometry of such racks varies widely, but in general it is desirable that such racks support one or more garbage cans of the 20 to 30 gallon variety in a position and in a way such that they cannot be over turned by wind or by marauding animals. It is also a desideratum that they be retained so that ready access can be obtained to the opening at the top of the cans for disposal of refuse.

GENERAL DESCRIPTION OF THE PRESENT INVENTION

The present invention provides a rack for mounting and retaining garbage cans in an elevated location in a way such that the cans can be easily removed from the rack for dumping the refuse therefrom into a garbage truck or other means of disposal. The open tops of the cans are readily accessible, and the cans are stably retained so that they are not blown over by the wind, nor easily upset by dogs or other marauding animals.

Broadly described, the garbage can rack of the invention includes a pair of vertically spaced, horizontally extending cross-bars or arms each attached at a central portion along the arm to a vertically extending supporting structure, and a pair of arcuate, generally circularly curved supporting elements each secured at a point on the periphery thereof to the lower of the two horizontally extending arms. The points of securement of the supporting elements are spaced substantially equidistantly on opposite sides of the center of the lower arm. A pair of horizontally spaced handle retention tabs are secured to, and project upwardly from, the upper of said two horizontally extending arms and are located above the points of securement of the arcuate supporting elements to the lower of the two horizontally extending arms.

An important object of the present invention is to provide a garbage can rack which is mechanically sturdy, yet can be economically fabricated and constructed, and which is versatile in that it can be placed in a number of locations, including attachment to any vertically extending post element or tree, or attachment to the post of a chain link fence or to the side of a barn or home.

A further object of the invention is to provide a garbage can rack for supporting a plurality of garbage cans at a location spaced above the ground to thereby permit mowing under the cans. The tops of the cans are supported at a level such that refuse can be dumped therein quite easily, and so that the handles of the cans can be easily gripped when it is desired to dump the refuse from the cans into a disposal vehicle or the like.

A further object of the invention is to provide a garbage can rack which can be very simply and easily used, and which is constructed so that it is relatively universal in the sense of the sizes of cans which can be supported and retained thereon.

Additional objects and advantages of the invention will become apparent as the following detailed description of the invention is read in conjunction with the accompanying drawings in which a preferred embodiment of the garbage can rack of the present invention is illustrated.

BROAD DESCRIPTION OF THE DRAWINGS

DETAILED DESCRIPTION OF A PREFERRED EMBODIMENT OF THE INVENTION

Figure 1:
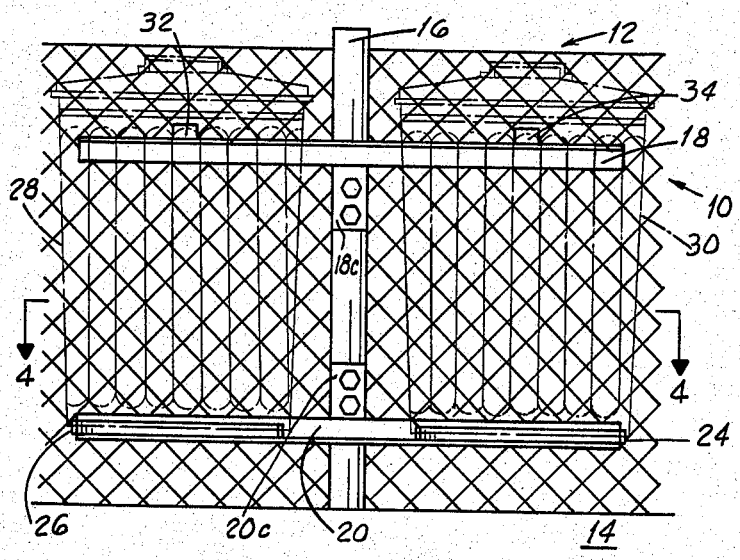
FIG. 1 is a front elevation view of a garbage can rack constructed in accordance with the present invention, and illustrating the rack as it is mounted on the post of a chain link fence and showing, in dashed lines, a pair of garbage cans supported thereon.

The garbage can rack of the invention is designated generally by reference numeral 10 and is shown mounted upon a chain link fence, designated generally by reference numeral 12. The rack 10 is adapted for supporting a plurality of garbage cans above the ground 14. The garbage can rack 10 includes a vertically extending post 16, which in the context of use illustrated, can be one of the posts of the chain link fence 12. The vertically extending post 16 is stably supported by burying the lower end of it in the earth, or in any other suitable way so as to afford rigidity and stability.

Secured to the vertically extending post 16 are a pair of horizontally extending, vertically spaced arms or cross-bars 18 and 20. In the illustrated embodiment of the invention, the arms 18 and 20 are a pair of angle members. Thus, the upper, horizontally extending arm 18 includes a horizontally extending flange **18*a* and a vertically extending flange 18*b*. The lower horizontally extending arm 20 includes a horizontally extending flange 20*a* and vertically extending flange 20*b*. The vertically extending flanges 18*b* and 20*b* each carry a tongue-like vertically extending projection 18*c* and 20*c*, respectively, and the projections 18*c* and 20*c* facilitate bolting the horizontally extending arms 18 and 20 to the post 16 by means of bolts 22 as illustrated in FIGS. 1 and 2**.

Secured to the horizontally extending flange **20*a* of the lower horizontally extending arm 20 are a pair of horizontally spaced, arcuate, generally semi-circular supporting elements 24 and 26. As illustrated in FIGS. 1 and 4, the supporting elements 24 and 26 are located substantially equidistantly on opposite sides of the post 16, and as best illustrated in FIGS. 2–4, each of the arcuate supporting elements is secured at a point on the periphery thereof to the lower of said two horizontally extending arms. Each of the arcuate supporting elements 24 and 26 is of a diametric dimension such that it fits snugly within the conventional downwardly projecting rim or flange which is formed at the lower end of most garbage receptacles or cans currently in use. Such cans are of the type illustrated in dashed lines in FIGS. 1–3 and there denominated by reference numerals 28 and 30. The arcuate supporting elements 24 and 26 are secured to the horizontally extending flange 20*a*** of the lower horizontally extending arm 20 at points or locations such that these arcuate supporting elements are spaced outwardly from the vertically extending flange 20*b* of the lower horizontally extending arm 20 by a distance which is approximately equivalent to the thickness of the flange or rim carried on the lower end of the garbage receptacle. This is illustrated in FIGS. 2, 3 and 4 of the drawings.

Figure 2:
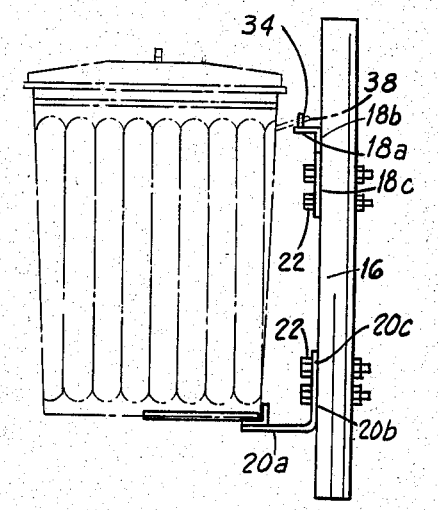
FIG. 2 is a side elevation view of the garbage can rack illustrated in FIG. 1, showing only the vertically extending post forming a part of the rack, and illustrating, in dashed lines, a garbage can supported on one part of the rack.
Figure 3:
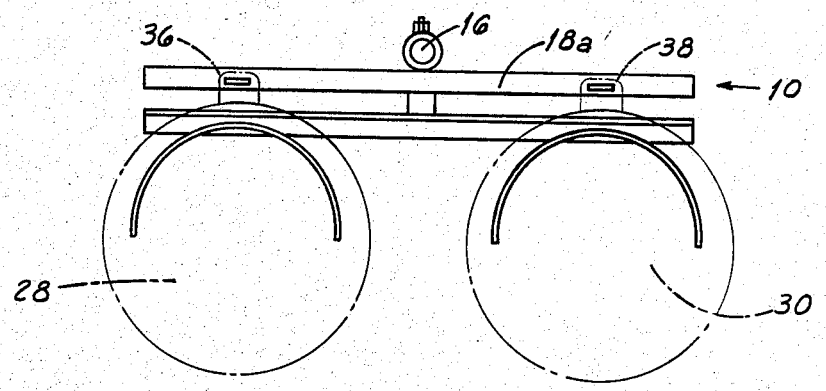
FIG. 3 is a top plan view of the garbage can rack of the invention illustrating, in dashed lines, a pair of garbage cans supported thereon.
Figure 4:
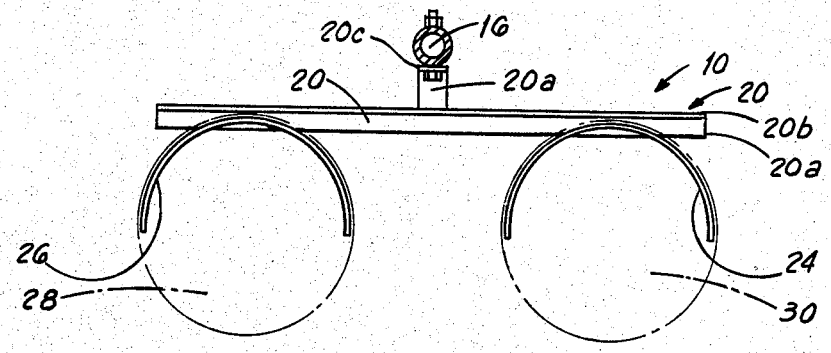
FIG. 4 is a plan view showing the lower portion of the garbage can rack of the invention.

It will also be noted in referring to FIGS. 2 and 3 that the lower horizontally extending arm 20 is spaced horizontally from the post 16 by means of L-shaped projection 20*c* a greater distance than are the handle retention tabs 32 and 34. This distance is such that the taper of the conventional garbage receptacle, by which it undergoes an enlargement of its diameter approaching its upper end, can be accommodated without the garbage receptacle tilting outwardly away from the post by an undue amount when the handle of the garbage receptacle is engaged with one of the respective retention tabs 32 or 34.

Welded or otherwise suitably secured to the horizontally extending flange 18*a* of the upper horizontally extending arm 18 are a pair of handle retention tabs 32 and 34. The handle retention tabs 32 and 34 are sized to permit the pivotally mounted handles 36 and 38 of the garbage cans 28 and 30 to be looped or passed over the tabs so as to retain the top of each of the cans in the desired position. Thus, the tabs 32 and 34 are located directly above the points of securement of the arcuate supporting elements 24 and 26 to the horizontally extending flange 20*a* of the lower horizontally extending arm 20.

In the utilization of the garbage can rack of the invention, the horizontally extending cross-bars or arms 18 and 20 are bolted to a suitable upstanding post, such as the post 16, or they can be secured to a tree or to the side of a house or barn. The garbage cans to be supported are then mounted on the rack so that the flange located at the bottom of each of the cans rests upon one of the supporting elements 24 or 26. The supporting element fits closely within the flange so that there is little opportunity for shifting of the can on the supporting element. The handle on each of the thus supported cans is looped over or hooked upon the respective handle retention tab 32 or 34 so as to stabilize the top of the can. The cans, as thus supported, can be easily filled, and can be easily removed from the rack for discharging the contents of the cans. Importantly also, the lawn beneath the cans can be mowed without the necessity of moving any part of the supporting structure.

Although a specific embodiment of the invention has been herein described, various changes and innovations in the described embodiment can be effected without departure from the basic principles which underlie the invention. Changes and innovations of this type are therefore deemed to be circumscribed by the spirit and scope of the invention except as the same may be necessarily limited by the appended claims, or reasonable equivalents thereof.

What is claimed is:

1. A garbage repository system comprising:

an upwardly extending post adapted to be placed in the earth;

a first, upper, horizontally extending arm of L-shaped cross-section having a horizontally extending flange and a vertically projecting flange;

a vertical projection secured to the center of the upper horizontally extending arm and bolted to the upwardly extending post;

a pair of horizontally spaced, vertically extending handle engaging tabs secured to said upper, horizontally extending arm and spaced equidistantly on opposite sides of said upwardly extending post;

a second, lower horizontally extending arm of L-shaped cross-section having a horizontally extending flange and a vertically projecting flange extending upwardly from said horizontally extending flange of the lower arm and normal thereto, said second, lower horizontally extending arm extending parallel to said first, upper horizontally extending arm;

a vertical projection secured to the center of the lower horizontally extending arm and bolted to the upwardly extending post;

a pair of horizontally spaced, semi-circular supporting elements each secured at a point on its periphery to said lower, horizontally extending arm and extending therefrom as a cantilever, the points of securement of said supporting elements being spaced equidistantly from said post on opposite sides thereof, and also being spaced horizontally from the vertically projecting flange of said lower horizontally extending arm of L-shaped cross-section in a direction away from said post whereby a downwardly projecting rim or flange on the lower side of a garbage receptacle can be accommodated in the space between the respective semi-circular support element and the vertically projecting flange of said second horizontally extending of L-shaped cross-section, and said points of securement being disposed in substantially vertical alignment with said handle engaging tabs; and a pair of horizontally spaced, cylindrical garbage cans each having a handle on the side thereof engaged with one of said handle engaging tabs, and each having an annular flange projecting downwardly from the lower side thereof and concentrically encircling, and juxtapositioned with respect to, one of said semi-circular supporting elements, the respective annular flange of each of said garbage cans passing between one of said semi-circular supporting elements and the vertically projecting flange of said second, lower horizontally extending arm of L-shaped cross-section to thereby stabilize the cans.

2. A support for garbage receptacles comprising:

an upwardly extending post adapted to be placed in the earth;

a first, upper, horizontally extending arm of L-shaped cross-section having a horizontally extending flange and a vertically projecting flange;

a vertical projection secured to the center of the upper horizontally extending arm and bolted to the upwardly extending post;

a pair of horizontally spaced handle engaging tabs secured to said upper, horizontaly extending arm and spaced equidistantly on opposite sides of said upwardly extending posts;

a second, lower horizontally extending arm of L-shaped cross-section having a horizontally extending flange and a vertically projecting flange extending upwardly from said horizontally extending flange of the lower arm and normal thereto, said second, lower horizontally extending arm extending parallel to said first, upper horizontally extending arm;

a vertical projection secured to the center of the lower horizontally extending arm and bolted to the upwardly extending post;

a pair of horizontally spaced, semi-circular supporting elements each secured at a point on its periphery to said lower, horizontally extending arm and extending therefrom as a cantilever, the points of said securement of said supporting elements being spaced equidistantly from said post on opposite sides thereof, and also being spaced horizontally from the vertically projecting flange of said lower horizontally extending arm of L-shaped cross-section whereby a downwardly projecting rim or flange on the lower side of a garbage receptacle can be accommodated in the space between the respective semi-circular support element and the vertically projecting flange of said second horizontally extending arm of L-shaped cross-section; and said lower horizontally extending arm and said semi-circular supporting elements secured thereto being spaced horizontally with respect to, and offset from, said handle engaging tabs, whereby the taper from an enlarged diameter at the upper side of a garbage receptacle to the lower end thereof is accommodated when a handle of the garbage receptacle is engaged with one of said tabs and the base thereof is supported on one of said semi-circular supporting elements with an annular flange carried at the lower end of the garbage receptacle concentrically encircling one of said semi-circular supporting elements.

3. A support for garbage receptacles comprising:

a vertically extending support structure adapted for stable earth support;

a first, upper, horizontally extending elongated arm of L-shaped cross-section positioned in a vertical plane and having a horizontally extending flange and a vertically projecting flange extending normal to the horizontally extending flange;

means detachably securing said first, upper, horizontally extending arm to said support structure with said vertically projecting flange in juxtaposition to said vertically extending support structure;

a pair of horizontally spaced handle engaging tabs secured to, and projecting upwardly from, said horizontally extending flange of said first, upper, horizontally extending arm;

a second, lower, horizontally extending arm of L-shaped cross-section having a horizontally extending flange and a vertically projecting flange extending upwardly from said horizontally extending flange of the lower arm and normal thereto, said second, lower, horizontally extending arm extending parallel to said first, upper, horizontally extending arm, and lying in a vertical plane spaced horizontally from the vertical plane in which said first, upper, horizontally extending arm is located;

an L-shaped vertical projection secured to the center of the second, lower, horizontally extending arm and detachably securing said lower, horizontally extending arm to said vertically extending support structure at a location spaced horizontally outwardly from said vertically extending support structure;

a pair of horizontally spaced, semi-circular supporting elements each secured at a point on its periphery and substantially midway between its ends to the horizontally extending flange of said second, lower, horizontally extending arm and extending therefrom as a cantilever, the points of securement of said supporting elements to said horizontally extending flange of said second, lower, horizontally extending arm being spaced horizontally from the vertically projecting flange of said lower, horizontally extending arm of L-shaped cross-section, whereby a downwardly projecting rim or flange on the lower side of a garbage receptacle can be accommodated in the space between the respective semi-circular support element and the vertically projecting flange of said second, lower, horizontally extending arm of L-shaped cross-section; and said lower, horizontally extending arm and said semi-circular supporting elements secured thereto being spaced horizontally with respect to, and from, said handle engaging tabs, whereby the taper from an enlarged diameter at the upper side of a garbage receptacle to the lower end thereof is accommodated when a handle of the garbage receptacle is engaged with one of said tabs, and the base thereof is supported on one of said semi-circular supporting elements with an annular flange carried at the lower end of the garbage receptacle concentrically encircling one of said semi-circular supporting elements.

* * * * *